US007784449B2

(12) United States Patent
Maly

(10) Patent No.: US 7,784,449 B2
(45) Date of Patent: Aug. 31, 2010

(54) VEHICLE, IN PARTICULAR A MOTOR VEHICLE WITH A TANK VENTILATION SYSTEM

(75) Inventor: Christian Maly, Kösching (DE)

(73) Assignee: Audi, AG, Ingolstadt (DE)

( * ) Notice: Subject to any disclaimer, the term of this patent is extended or adjusted under 35 U.S.C. 154(b) by 0 days.

(21) Appl. No.: 12/175,374

(22) Filed: Jul. 17, 2008

(65) Prior Publication Data

US 2009/0044785 A1 Feb. 19, 2009

(30) Foreign Application Priority Data

Jul. 18, 2007 (DE) ..... 10 2007 033 411

(51) Int. Cl.
*F02M 33/02* (2006.01)

(52) U.S. Cl. ..... 123/516; 123/518; 123/519; 123/521

(58) Field of Classification Search ..... 123/516, 123/518, 519, 520, 521, 531, 533
See application file for complete search history.

(56) References Cited

U.S. PATENT DOCUMENTS 4,059,081 A * 11/1977 Kayanuma ..... 123/520
4,070,828 A * 1/1978 Barres ..... 60/274
4,168,686 A * 9/1979 Wakita et al. ..... 123/521
5,050,568 A * 9/1991 Cook ..... 123/521
5,080,078 A * 1/1992 Hamburg ..... 123/521
5,194,075 A * 3/1993 Matsuoka ..... 96/144
5,273,020 A 12/1993 Hayami
5,275,145 A * 1/1994 Tuckey ..... 123/521
5,383,437 A * 1/1995 Cook et al. ..... 123/520
5,499,614 A * 3/1996 Busato et al. ..... 123/520
5,553,577 A * 9/1996 Denz et al. ..... 123/198 D
5,635,630 A * 6/1997 Dawson et al. ..... 73/40.5 R
6,279,547 B1 * 8/2001 Mancini et al. ..... 123/516
6,732,718 B2 * 5/2004 Kano et al. ..... 123/518
7,107,759 B2 * 9/2006 Annoura et al. ..... 60/283
7,464,698 B2 * 12/2008 Maegawa ..... 123/519
7,484,500 B2 * 2/2009 Terada ..... 123/516
7,568,472 B2 * 8/2009 Woody ..... 123/517
2005/0011185 A1 1/2005 Annoura et al.

FOREIGN PATENT DOCUMENTS

DE 195 02 775 C1 6/1996

* cited by examiner

*Primary Examiner*—Thomas N Moulis
(74) *Attorney, Agent, or Firm*—Novak Druce + Quigg

(57) ABSTRACT

The invention relates to a motor vehicle, with a fuel tank which has tank ventilation, the tank ventilation for adsorption of fuel vapors having an activated charcoal filter through which a flushing air flow can flow, and with a vehicle unit which has a vacuum pump, in particular a brake booster. It is provided that the delivery side of the vacuum pump produces compressed air for driving the flushing air flow and/or that the compressed air forms the flushing air flow.

12 Claims, 3 Drawing Sheets

VEHICLE, IN PARTICULAR A MOTOR VEHICLE WITH A TANK VENTILATION SYSTEM

CROSS-REFERENCE TO RELATED APPLICATIONS

This application claims priority from German Patent Application No. 10 2007 033 411.9 filed Jul. 18, 2007.

The invention relates to a vehicle, in particular a motor vehicle with a tank ventilation system.

BACKGROUND OF THE INVENTION

Vehicles, in particular motor vehicles, are equipped with tank ventilation systems which provide for the desired pressure conditions within the fuel tank and in particular prevent concentration of the hydrocarbons (especially in the gaseous phase) which have dissolved out of the fuel. The dissipation of these hydrocarbons into the environment is undesirable, therefore tank ventilation systems for adsorption of fuel vapors are provided with activated charcoal filters. These activated charcoal filters must be regenerated, that is, in the broadest sense cleaned, specifically the adsorbed hydrocarbons in them must be removed. The prior art discloses applying a negative pressure from the manifold passage of the internal combustion engine to the activated charcoal filter by way of a tank ventilation valve so that the activated charcoal filter which acquires feed air via a fresh air line which is located in the remaining system of the internal combustion engine is flushed. This fuel vapor-enriched flushing air is supplied again to combustion, specifically in the region of the manifold passage of the internal combustion engine. The activated charcoal filter is therefore flushed with ambient air by application of negative pressure, specifically from the manifold passage, the fuel vapors being supplied to combustion depending on the negative pressure of the manifold passage. Here it is disadvantageous that at a low negative pressure in the intake duct of the internal combustion engine with the throttle valve opened wide, not enough flushing air is intaken via the activated charcoal filter to adequately regenerate it. In unfavorable cases this can lead to so-called bleeding of fuel vapors, in which the fuel vapors are undesirably released into the exterior; this results in a gasoline odor of the vehicle. These operating states occur in particular at a high degree of loading of the activated charcoal filter, with high temperatures in the fuel tank and high load, in particular when driving uphill at higher elevations. Furthermore, operating states are conceivable, in particular for a high degree of loading of the activated charcoal filter and idling, in which normal idling of the internal combustion engine can be maintained solely with the fuel vapors which have been flushed out of the activated charcoal filter; in particular, controlled idling free of problems is hardly possible in this connection. Furthermore, after long stationary periods of the vehicle under incident solar radiation, the activated charcoal filter is often highly saturated, so that for tank ventilation which has been activated after a long stationary time the lambda control finds an unadapted fuel induction system so that adverse effects on vehicle handling occur. In particular, operating points with low throughput or high negative pressure are critical here since the ratio between the measured air mass and the unmeasured fuel vapors from the activated charcoal filter is unfavorable. Furthermore it is disadvantageous that the activated charcoal filter cannot be flushed in the entire range of characteristics without adverse effects on the engine operating behavior or the vehicle handling. The object of the invention is to provide a vehicle with a tank ventilation system which avoids these defects.

SUMMARY OF THE INVENTION

For this purpose a vehicle, in particular a motor vehicle, with a fuel tank which has tank ventilation, is proposed, the tank ventilation for adsorption of fuel vapors having an activated charcoal filter through which a flushing air flow can flow, and with a vehicle unit which has a vacuum pump, in particular a brake booster. For this purpose it is provided that the delivery side of the vacuum pump produces compressed air for driving the flushing air flow and/or that the compressed air forms the flushing air flow. Unlike the tank ventilation systems known in the prior art, flushing of the activated charcoal filter here is not achieved by application of negative pressure to it via the manifold passage of the internal combustion engine, but by supplying compressed air which is taken from the delivery side of the vacuum pump of the vehicle unit. The negative pressure, as is made available by the vacuum pump, is required in broad areas of motor vehicles for secondary units, conversely the overpressure which arises in this connection/the compressed air which forms in this connection is generally blown off unused. This compressed air is used according to the invention to supply compressed air to the activated charcoal filter for flushing. It is advantageous here that the flushing process is basically independent of the pressure conditions in the combustion line, in particular in the induction tract of the internal combustion engine. Compared to existing systems, here only minor modifications are necessary, in particular, for example, the elimination of the vacuum pump pressure output which at present generally injects into the cylinder crankcase, and via which the air which has been evacuated from the secondary unit is conveyed into the cylinder crankcase, and/or the layout of this vacuum pump pressure output such that the compressed air for the activated charcoal filter can be made available by way of the pressure output. In this way flushing of the activated charcoal filter which is independent of the operating state of the internal combustion engine can be achieved.

In another embodiment, it is provided that the vehicle assembly is a brake booster. The brake booster is always required during operation of the vehicle and therefore is always supplied with negative pressure from a vacuum pump (driven generally by way of the camshaft). On the delivery side of the vacuum pump, consequently during the entire operation of the internal combustion engine, the overpressure/compressed air, which is necessary for the invention, is in readiness.

In another embodiment, in the tank ventilation downstream from the fuel tank and upstream from the activated charcoal filter there is a nonreturn valve which blocks in the direction to die fuel tank. This prevents fuel vapors from being conveyed back into the fuel tank and the fuel tank from being undesirably exposed to a flushing air flow and/or compressed air flow.

In another embodiment, there is an overpressure valve in the compressed air line which connects the delivery side of the vacuum pump to the activated charcoal filter. In this way, inducing an undesirably high pressure level ii the activated charcoal filter or the components connected to it is prevented.

In another embodiment, it is provided that downstream from the activated charcoal filter there is an exhaust air line which has a tank ventilation valve, which connects the filter to the induction tract of the internal combustion engine of the vehicle, and which downstream from the air filter discharges into the induction tract. The exhaust air line is a flushing air line which delivers the flushing air by way of the tank ventilation valve into the induction tract of the internal combustion engine for combustion.

In another embodiment it is provided that the exhaust air line upstream from an exhaust gas turbocharger of the internal combustion engine discharges into the induction tract of the internal combustion engine. For turbocharged engines this version allows very advantageous supply of flushing air for combustion, in particular bypassing interaction with the negative pressure of the manifold passage.

In another embodiment it is provided that downstream from the activated charcoal filter there is an intake jet pump which produces the flushing air flow and which is driven by the compressed air of the vacuum pump. In this embodiment the activated charcoal filter is not supplied with compressed air/overpressure, but with a negative pressure, this negative pressure, however, not, as in the prior art, originating from the induction tract, in particular the manifold passage of the internal combustion engine, but from an intake jet pump which is driven by the overpressure of the delivery side of the vacuum pump. The driving jet of the intake jet pump in this connection is the compressed air flow of the vacuum pump which passes through a driving nozzle with a velocity such that an additional volumetric flow from the activated charcoal filter is entrained and thus is conveyed into the flushing air line which is located downstream from the intake jet pump. As described in the foregoing, this flushing air line is connected to the induction tract of the internal combustion engine by way of the tank ventilation valve.

In another embodiment, the activated charcoal filter is connected to a flushing air feed opening which is connected to the exterior. In this connection it must be ensured that the flushing air feed opening is unidirectional, that is, escape of hydrocarbon vapors/fuel vapors into the environment is avoided. The flushing air feed opening is especially suited for particularly effective flushing/regeneration of the activated charcoal filter in conjunction with an intake jet pump.

In another embodiment, the activated charcoal filter is connected via an intake duct for intaking fuel vapors to a changeover valve for switching the negative pressure supply of the vehicle unit and of the activated charcoal filter by way of the intake side of the vacuum pump. The vacuum pump accordingly delivers on the one hand from the vehicle unit, in particular the brake booster, on the other hand from the activated charcoal filter. The delivery side here is connected to the induction tract of the internal combustion engine by way of the tank ventilation valve, in particular upstream from the exhaust gas turbocharger. The vacuum pump delivers in alternation, and controlled by way of the changeover valve, from the activated charcoal filter and from the brake booster. Changeover here takes place depending on the operating state. As already known from the embodiments from the prior art, here regeneration of the activated charcoal filter takes place by way of an intake, not by way of compressed air supply (blowing out). In contrast to the embodiments known from the prior art, however, the intake is independent of the operating state of the internal combustion engine; in particular, the intake is independent of the pressure conditions prevailing in the induction tract of the internal combustion engine. Unlike the prior art, the activated charcoal filter or the canister which surrounds it is not supplied with negative pressure (dependent on the operating state or load) from the induction tract, in particular the manifold passage, but with the negative pressure of the vacuum pump of a vehicle unit, for example the brake booster. In this way it can be ensured that the activated charcoal filter is always advantageously supplied with more or less the same negative pressure of the vacuum pump. By changeover via the changeover valve, regeneration of the activated charcoal filter can take place in intervals during which the brake booster is, for example, not needed, or demand regeneration of the activated charcoal filter can take place by way of dedicated changeover without influencing the action of the brake booster.

In another embodiment the changeover valve is an electric changeover valve. This allows easy triggering within existing control systems of the motor vehicle.

In another preferred embodiment, downstream from the delivery side of the vacuum pump there is an oil separator, for example in the compressed air line. The oil separator prevents lubricants, in particular lubricating oil, from overflowing via the compressed air line to the activated charcoal filter or to the induction tract. In this way an adverse effect on the operating behavior of the internal combustion engine by unwanted entry of lubricant is reliably prevented.

BRIEF DESCRIPTION OF THE DRAWINGS

The invention is detailed below using embodiments and figures.

FIG. 1 shows a tank ventilation system 1 of a vehicle which is not shown, with a fuel tank 2, an activated charcoal filter 4 which is located in the activated charcoal filter canister 3, a tank ventilation valve 5, and an internal combustion engine 6. The internal combustion engine is assigned an air filter 7, an exhaust gas turbocharger 8 and an induction tract 9, the induction tract 9 comprising a throttle valve 10 and the manifold passage 11. The air filter 7 is used for intake and cleaning of combustion air; downstream from it is the exhaust gas turbocharger 8 with the induction tract 9 located downstream from it. The fuel tank 2 for its filling has a fill neck 12; fuel 13 is stored in the fuel tank 2. The fuel tank 2, preferably on the top side, has a tank ventilation line 14 which is connected downstream from the activated charcoal filter canister 3 with the activated charcoal filter 4 located in it. Downstream from the activated charcoal filter canister 3 there is a tank ventilation valve 5 which is connected by way of an exhaust air line 15 to the activated charcoal filter canister 3 on the one hand and downstream from the tank ventilation valve 5 to an intake duct 16 which connects the air filter 7 to the exhaust gas turbocharger for feeding the hydrocarbon-saturated air which has been delivered from the activated charcoal filter canister 3 into the induction tract 9 of the internal combustion engine 6. The vehicle, which is not shown, furthermore has a vacuum pump 17 which has a delivery side 18 and an intake side 9. The intake side 19 of the vacuum pump 17 is connected to a vehicle unit 22, specifically the brake booster 23, by way of an electrical changeover valve 20 and a nonreturn valve 21. The electrical changeover valve 20 has another input 24 which communicates with the ambient air 25. The vacuum pump 17 thus supplies the brake booster 23 as the vehicle unit 22 via the electrical changeover valve 20, either via the nonreturn valve 21, or it delivers ambient air 25 from the exterior, in the other operating state of the electrical changeover valve 20. The delivery side 18 of the vacuum pump 17 is connected downstream to a compressed air line 26 which via an oil separator 37 and via an overpressure valve 27 supplies the activated charcoal filter canister 3 connected downstream to it with the activated charcoal filter 4 located in it with a flushing air flow 28. The flushing air flow 28 is consequently formed by ambient air 25 which is injected into the activated charcoal filter canister 3 from the delivery side 18 of the vacuum pump 17 by way of the compressed air line 26. The overpressure valve 27 here prevents an inappropriate pressure level in the region of the activated charcoal filter canister 3. In addition, between the activated charcoal filter canister 3 and the fuel tank 2 in the region of the tank ventilation line 14 there is a nonreturn valve 29 which blocks in the direction to the fuel tank 2. The nonreturn valve 29 prevents flashback of fuel vapors 30, which is possible as a result of the overpressure delivered into the activated charcoal filter canister 3 by means of the flushing air flow 28, via the tank ventilation line 14 into the fuel tank 2. The flushing air flow 28 supplied via the compressed air line 26 is saturated when passing through the activated charcoal filter 4 by the fuel vapors 30 which have been adsorbed in it and leaves the activated charcoal filter canister 3 as an exhaust air flow 31 via the exhaust air line 15. The exhaust air line 15 is routed via the tank ventilation valve into the intake air line 16 of the internal combustion engine 6. By way of the intake air line 16 the exhaust air flow 31 thus travels via the exhaust gas turbocharger 8 and the induction tract to combustion in the internal combustion engine 6. Blowing out of the vacuum pump 17 which was conventional in the prior art via the delivery side 18 into the internal combustion engine 6, in particular the crankcase of the internal combustion engine 6 which is not shown here, is no longer necessary since the compressed air from the vacuum pump 17 together with the ambient air 25 (controlled via the electrical changeover valve 20) forms the flushing air flow 28 for regeneration of the activated charcoal filter 4. This enables operation of the tank ventilation system, in particular of activated charcoal filter regeneration, which is completely independent of the pressure conditions in the induction tract 9, in particular in the manifold passage 11, of the internal combustion engine 6. Activated charcoal filter regeneration in its effectiveness is therefore independent of the operating states of the internal combustion engine 6 and does not adversely affect vehicle handling.

FIG. 2 shows another embodiment of the tank ventilation system 1, in turn with the fuel tank 2 in which fuel 13 is stored, the activated charcoal filter canister 3 which is connected to the fuel tank 2 via the tank ventilation line 14, with the activated charcoal filter 4 located in it, in which fuel vapors 30 are adsorbed, the tank ventilation valve 5 which connects the activated charcoal filter canister 3 to the intake air line 16 downstream from the air filter 7 and upstream from the exhaust gas turbocharger 8 and of the induction tract 9 of the internal combustion engine 6 which has the throttle valve 10 and the manifold passage 11. In turn, the vehicle furthermore has a vacuum pump 17 with a delivery side 18 and an intake side 19, in turn the intake side 19 of the vacuum pump 17 being connected to the ambient air 25 via the electrical changeover valve 20 on the one hand, via one operating state of the electrical changeover valve 20 and its other input 24, on the other hand via the nonreturn valve 21 to the vehicle unit 22, specifically the brake booster 23. The delivery side 18 of the vacuum pump is connected by way of the oil separator 37 to an intake jet pump 32 which is located in the exhaust air line 15 between the activated charcoal filter canister 3 and the tank ventilation valve 5, and is used in this connection via the overpressure produced by it to form a driving jet in the intake jet pump 32 for operating the flushing air flow 28, the flushing air flow 28 travelling via the flushing air feed opening 33 which is connected to the exterior, in particular the ambient air 25, into the activated charcoal filter canister 4 and, saturated with the fuel vapors 30 adsorbed there in the activated charcoal filter 4, leaves the activated charcoal filter canister 3 as exhaust air 31 via the exhaust air line 15, specifically via the intake jet pump 32, and is supplied via the tank ventilation valve 5 to the intake air line 16 of the internal combustion engine 6 for purposes of combustion. The flushing air feed opening 33 is made as a unidirectional channel 34, that is, as one which does allow admission of the ambient air 25 for formation of the flushing air flow 28 to the activated charcoal filter canister 3, but does not allow escape of the gases located in the activated charcoal filter canister 3, in particular of fuel vapors 30, into the exterior. In this embodiment, negative pressure supply to the activated charcoal filter canister 3 which is independent of the operating states of the internal combustion engine 6 and a corresponding continuous delivery of the flushing air flow 28 are ensured so that activated charcoal filter regeneration is essentially completely independent of the operating and load states of the internal combustion engine 6 and in particular does not adversely influence the handling of the vehicle or the operating behavior of the internal combustion engine 6 either.

FIG. 3 shows another embodiment of the tank ventilation system 1 with the fuel tank 2 which contains the fuel 13, the activated charcoal filter canister 3 which contains the activated charcoal filter 4 and which is located downstream from the tank via the tank ventilation line 14, and in which there are fuel vapors 30, the internal combustion engine 6 with the induction tract 9 which encompasses the throttle valve 10 and the manifold passage 11, and to which the exhaust gas turbocharger 8 is located upstream and the air filter 7 in turn is located upstream from the turbocharger. In turn, the vehicle furthermore has a vacuum pump 17 for negative pressure supply to the vehicle unit 22, specifically the brake booster 23, via the electrical changeover valve 20 and the nonreturn valve 21, the negative pressure being supplied via the intake side 19 of the vacuum pump 17. The electrical changeover valve 20 furthermore in turn has another input 24 for another operating position, the other input 24 of the electrical changeover valve 20 being connected via the intake duct 35 to the activated charcoal filter canister 3 and thus to the activated charcoal filter 4. The fuel vapors 30 in the activated charcoal filter canister 3 are consequently intaken via the intake duct 35, for supply of flushing air to form the flushing air flow 28 the activated charcoal filter canister 3 having a flushing air feed opening 33 (as a unidirectional channel 34). Via the flushing air feed opening 33 ambient air 25 travels from the exterior of the activated charcoal filter canister 3 with formation of the flushing air flow 28 into the activated charcoal filter canister 3 which is supplied with an negative pressure via the intake duct 25. The exhaust air 31 is supplied from the activated charcoal filter canister 3 accordingly via the intake duct 35 and the electrical changeover valve 20 in its other operating position via its other input 24 to the vacuum pump 17. From here the exhaust air 31 is supplied by way of the oil separator 37 which is located downstream from the delivery side 18 of the vacuum pump 17 via an exhaust air pressure line 36 to the tank ventilation valve 5 which supplies the exhaust air 31 to the intake duct 16 located downstream from it (downstream from the air filter 7 and upstream from the exhaust gas turbocharger 8) for combustion in the internal combustion engine 6. In this way negative pressure supply which is independent of the operating and load state of the internal combustion engine 6 and thus flushing of the activated charcoal filter 6 can be achieved, since the negative pressure is no longer dependent on the negative pressure in the manifold passage 11, as is known from the prior art. Rather, with direct coupling to the, for example, camshaft-driven vacuum pump 17, rpm-dependent flushing and regeneration of the activated charcoal filter 4 can be achieved, with very high flushing rates at high rpm so that at low load and idle, that is, operating points of the internal combustion engine 6 which are critical for vehicle handling, there is no need for flushing of the activated charcoal filter 4. It is especially advantageous in the illustrated embodiments that the vacuum pump 17, which already is driven continuously by the internal combustion engine 6, provides an additional benefit in which it drives or makes available the flushing air flow 28. The illustrated embodiments greatly reduce the risk of bleeding of the fuel vapors 30 out of the activated charcoal filter canister 3 into the exterior, as can occur in the solutions known from the prior art under extreme conditions, for example, at very high temperatures, when driving continuously uphill or at higher elevations above sea level. Likewise, the required tank ventilation paths known in the prior art for the exhaust gas-turbocharged internal combustion engines 6 between the tank ventilation valve 5 and the induction tract 9 can be eliminated. Changeover between induction and charging operation with respect to tank ventilation is not necessary. The fuel vapors 30 from the activated charcoal filter canister 3 are supplied exclusively upstream from the exhaust gas turbocharger 8 for combustion in the internal combustion engine 6.

REFERENCE NUMBER LIST

Figure 1:
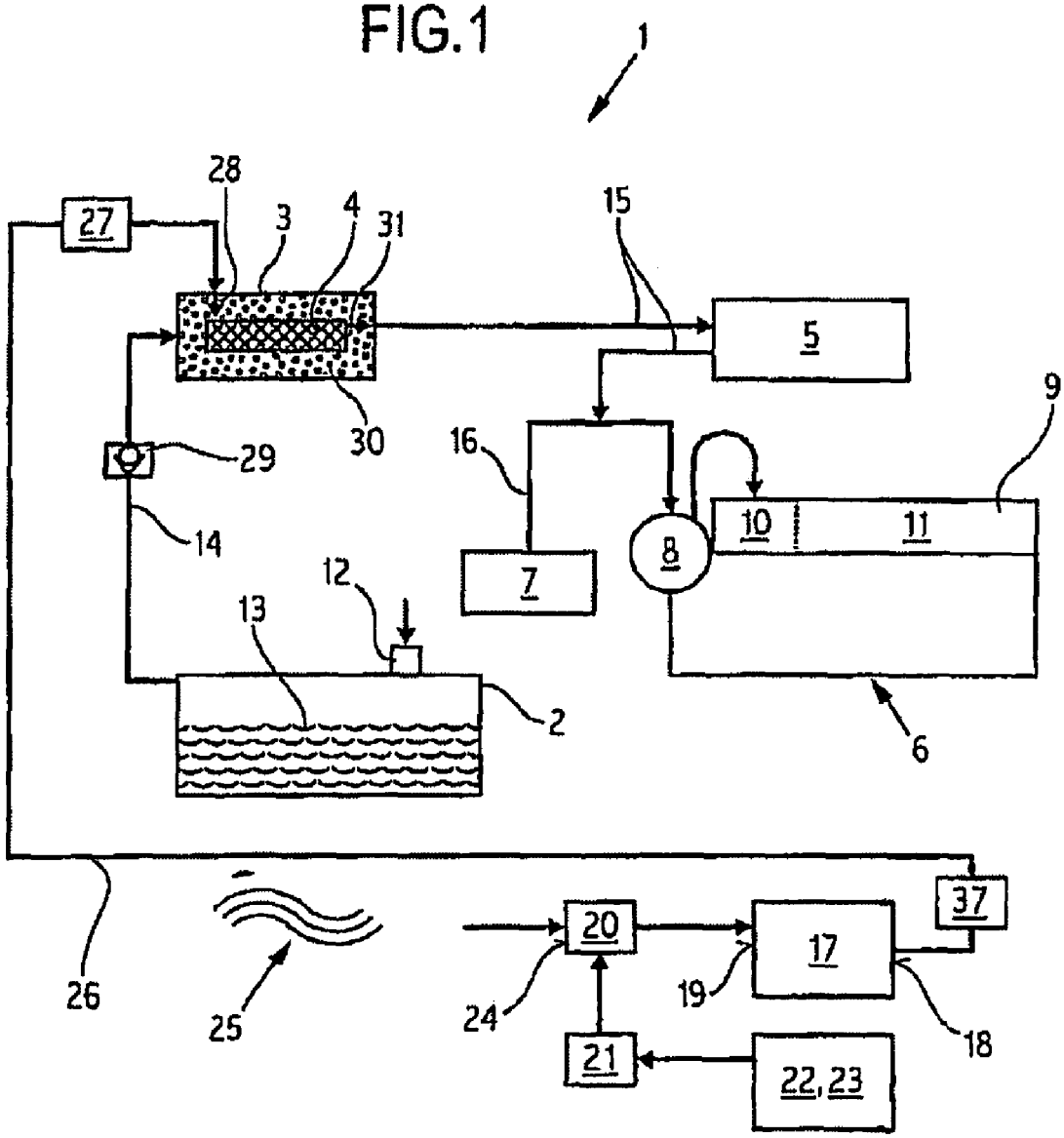
FIG. 1 shows a tank ventilation system of a vehicle with activated charcoal filter regeneration by compressed air supply via the delivery side of a vacuum pump.
Figure 2:
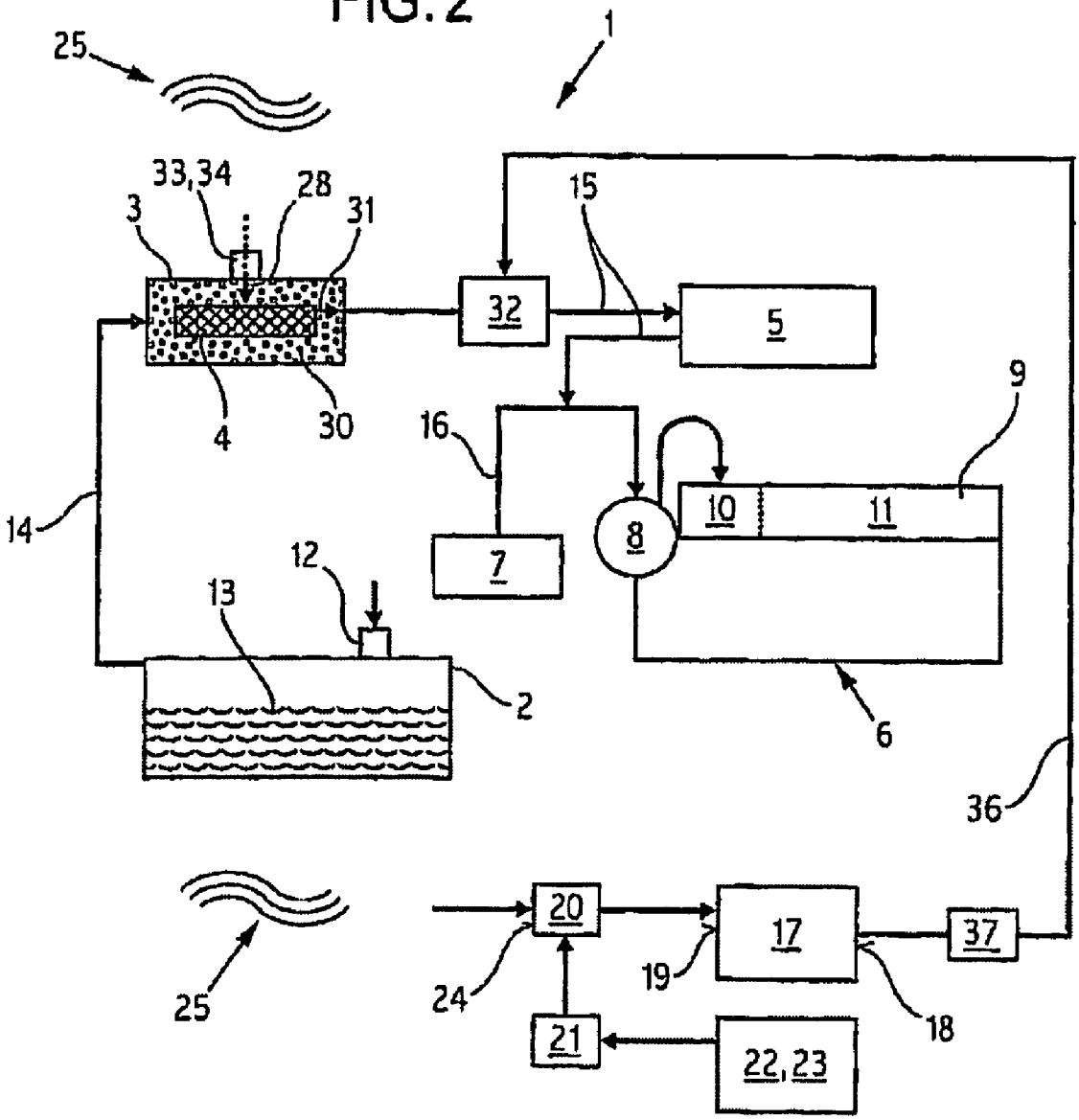
FIG. 2 shows such a tank ventilation system with activated charcoal filter regeneration by way of an intake jet pump and FIG. 3 shows activated charcoal filter regeneration by way of intake by means of a vacuum pump of a vehicle unit.
Figure 3:
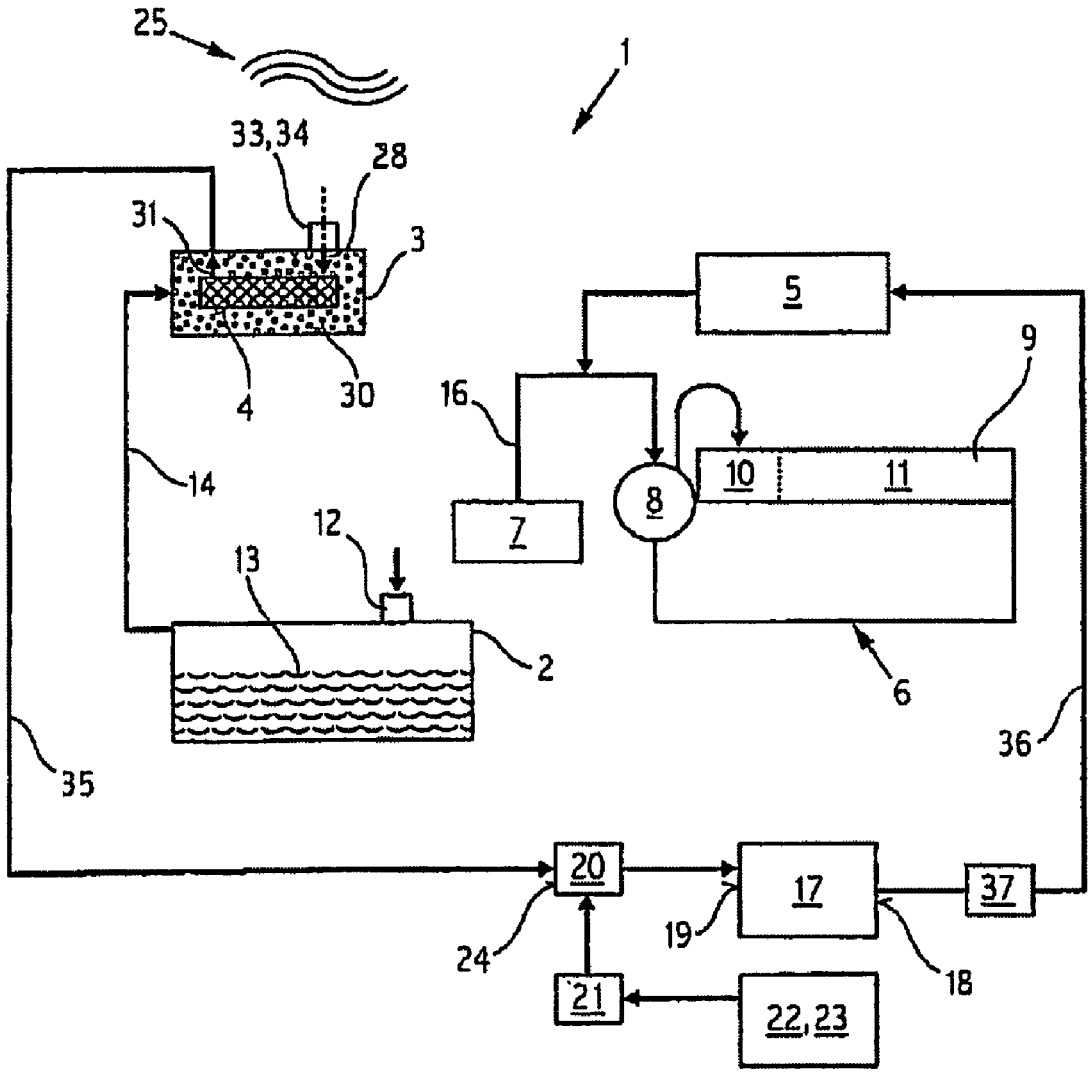

1 tank ventilation system
2 fuel tank
3 activated charcoal filter canister
4 activated charcoal filter
5 tank ventilation valve
6 internal combustion engine
7 air filter
8 exhaust gas turbocharger
9 induction tract
10 throttle valve
11 manifold passage
12 fill neck
13 fuel
14 tank ventilation line
15 exhaust air line
16 intake air line
17 vacuum pump
18 delivery side
19 intake side
20 electrical changeover valve
21 nonreturn valve
22 vehicle unit
23 brake booster
24 other input
25 ambient air
26 compressed air line
27 overpressure valve
28 flushing air flow
29 nonreturn valve
30 fuel vapor
31 exhaust air
32 intake jet pump
33 flushing air feed opening
34 unidirectional channel
35 intake duct
36 exhaust air pressure line
37 oil separator

The invention claimed is:

1. In a vehicle having an internal combustion engine, a fuel tank, a fuel vapor supply line intercommunicating said fuel tank and an intake manifold of said engine, and a charcoal filter canister disposed in said fuel vapor supply line, a system for purging fuel vapor in said charcoal filter canister comprising a vacuum pump for a brake booster having one of an inlet communicable with the ambient air and an outlet communicable with an injection device disposed in said fuel vapor supply line between said charcoal filter canister and said intake manifold, and an inlet communicable with said charcoal filter canister and an outlet communicable with said intake manifold.

2. A system according to claim 1 wherein said outlet of said vacuum pump is communicable with said injection device and said charcoal filter canister is provided with an ambient air inlet provided with a one-way valve.

3. A system according to claim 1 wherein said inlet of said vacuum pump is communicable with said charcoal filter canister and said outlet thereof is communicable with said intake manifold, said charcoal filter canister is provided with an ambient air inlet provided with a one-way valve.

4. a system according to claim 1 including an oil separator disposed downstream of said vacuum pump.

5. In a vehicle having an internal combustion engine, a fuel tank, a fuel vapor supply line intercommunicating said fuel tank and an intake manifold of said engine, and a charcoal filter canister disposed in said fuel vapor supply line, a system for purging fuel vapor in said charcoal filter canister comprising a vacuum pump having one of an inlet communicable with the ambient air and an outlet communicable with an injection device disposed in said fuel vapor supply line between said charcoal filter canister and said intake manifold, and an inlet communicable with said charcoal filter canister and an outlet communicable with said intake manifold, including an oil separator disposed downstream of said vacuum pump.

6. A system according to claim 5 wherein said vacuum pump comprises a vacuum pump for a brake booster.

7. A system according to claim 5 wherein where said outlet of said vacuum pump is communicable with said injection device and said charcoal filter canister is provided with an ambient air inlet provided with a one-way valve.

8. A system according to claim 5 wherein said inlet of said vacuum pump is communicable with said charcoal filter canister and said outlet thereof is communicable with said intake manifold and said charcoal filter canister is provided with an ambient air inlet provided with a one-way valve.

9. In a vehicle having an internal combustion engine, a fuel tank, a fuel vapor supply line intercommunicating said fuel tank and an intake manifold of said engine, and a charcoal filter canister disposed in said fuel vapor supply line, a system for purging fuel vapor in said charcoal filter canister comprising a jet pump disposed in said fuel vapor supply line between said canister and said intake manifold and a vacuum pump having an inlet communicable with the ambient air and an outlet communicable with said jet pump.

10. A system according to claim 9 wherein said vacuum pump comprises a vacuum pump for a brake booster.

11. A system according to claim 9 wherein said charcoal filter canister is provided with an ambient air inlet provided with a one-way valve.

12. A system according to claim 9 including an oil separator disposed downstream of said vacuum pump.

* * * * *